US006364465B1

(12) United States Patent
Chandrasekaran

(10) Patent No.: US 6,364,465 B1
(45) Date of Patent: Apr. 2, 2002

(54) INK JET HEADS HAVING PHOTORESIST LAYER CONTAINING POLY (AMIC ACID)

(75) Inventor: Karuppiah Chandrasekaran, Sayre, PA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 08/917,262

(22) Filed: Aug. 25, 1997

Related U.S. Application Data

(63) Continuation of application No. 08/498,863, filed on Jul. 6, 1995, now abandoned.

(51) Int. Cl.[7] ..... B41J 2/05

(52) U.S. Cl. ..... 347/65; 347/64; 347/63; 347/44; 347/45

(58) Field of Search ..... 347/65, 63, 64, 347/45, 44

(56) References Cited

U.S. PATENT DOCUMENTS

| | | | | | |
|---|---|---|---|---|---|
| 3,179,614 | A | * | 4/1965 | Edwards | |
| 4,417,251 | A | * | 11/1983 | Sugitani | 347/65 |
| 4,451,551 | A | * | 5/1984 | Kataoka et al. | 430/270.1 |
| 4,774,530 | A | * | 9/1988 | Hawkins | 347/63 |
| 4,970,532 | A | * | 11/1990 | Komuro et al. | 347/65 |
| 5,310,862 | A | * | 5/1994 | Nomura et al. | 528/353 |
| 5,348,835 | A | * | 9/1994 | Oba et al. | 430/192 |

FOREIGN PATENT DOCUMENTS

| | | | |
|---|---|---|---|
| JP | S62-1726 | 1/1987 | C08G/73/10 |
| JP | S62-1727 | 1/1987 | C08G/73/10 |

* cited by examiner

*Primary Examiner*—John Barlow
*Assistant Examiner*—Manish Shah

(57) ABSTRACT

The durability of ink jet print heads is improved when the intermediate photoresist layer contains a poly(amic acid) prepared from at least one dianhydride and at least one aliphatic diamine.

13 Claims, No Drawings

INK JET HEADS HAVING PHOTORESIST LAYER CONTAINING POLY (AMIC ACID)

This is a continuation, of application Ser. No. 08/498,863 filed Jul. 6, 1995, now abandoned.

FIELD OF THE INVENTION

This invention relates to ink jet print heads and, more preferably, to print heads having improved durability.

BACKGROUND OF THE INVENTION

Ink jet print heads are sandwich structures having top and bottom plates, and a dry film photoresist intermediate layer that defines liquid pathways and discharge orifices. The top plate contains the ink nozzles, and typically is made of a noble metal, glass or plastic. The bottom plate typically is a thermally stable substrate, such as a silicon wafer, that bears microcircuits. Microresistors are mounted on the substrate, projecting into the liquid pathways in the photoresist layer, in alignment with the ink nozzles. At computer command, the resistors superheat nearby ink, creating a steam bubble that forces ink droplets out the nozzles.

The dry film photoresist layer must meet many demanding requirements. It must be capable of being imaged to the fine resolution needed to define the ink passageways. The layer must be dimensionally stable (e.g., not swell) and capable of withstanding chemical attack from the hot aqueous inks, which typically have high pH and contain organic components. Moreover, the layer must remain firmly bonded to the top and bottom plates, which frequently are constructed of materials difficult to bond to (e.g., gold), during millions of firing cycles, despite stresses that tend to cause delamination.

Various photoresist materials have been proposed to meet the demanding requirements of print head construction. For example, Japanese Patent Application 5-278222, published Oct. 26, 1993, discloses a dry photoresist film containing a half acryloyl ester of a bis-phenol A epoxy monomer, a photoinitiator, and a polymeric binder that is said to be particularly useful for this purpose. Vacrel® solder mask material, a photoresist material sold by E. I. du Pont de Nemours and Company that contains acrylic and melamine monomers, photoinitiator, and an acrylic binder with acidic functions for water-based development, also has been used for this purpose.

The inks contained in the print heads contain cosolvents to improve their daytime and water fastness. However, these cosolvents have a tendency to swell known resist layers causing them to delaminate from the top and bottom plates, leading to failure of the print head.

Although known dry film photoresists have proven useful, further improvements are desired to achieve the desired durability for extended use of ink jet print heads.

SUMMARY OF THE INVENTION

It now has been found that the photoresists containing poly(amic acid) will improve durability of the print heads. Accordingly, the present invention provides an ink jet print head having a top plate, an intermediate photoresist layer defining ink passageways, and a bottom plate, wherein the photoresist layer, prior to imaging to form the passageways, contains an ethylenically unsaturated compound, a photoinitiator, and a poly(amic acid) prepared from at least one dianhydride and at least one aliphatic diamine.

The photopolymerizable poly(amic acid) solutions can also be used to make solder masks, photoimageable coverlays, for flexible circuits, optical wave guides and an adhesiveless laminate to make disk drives.

DETAILED DESCRIPTION OF THE INVENTION

While the details of print head design will vary with the manufacturer, the print head 10 (as seen in FIG. 1) generally has a top plate, 11 (which is shown partly sectioned to permit illustration of the ink passageways) an intermediate photoresist layer 12, and a bottom plate 13. The intermediate photoresist layer 12 is a dry film that is imaged during the manufacturing process, followed by removal of non-exposed regions of the photoresist, to form ink passageways 14, 15. It is critical that the photosensitive or photoresist layer 12 remain firmly bonded to the top 11 and bottom 13 layers of the print head 10 during extended use, and be resistant to chemical attack or swelling by the inks, which are aqueous based and typically contain organic components.

BOTTOM PLATE

The bottom plate serves as a mounting platform for microresistors or other elements used to generate pressure to discharge the ink, such as heat generating or piezo elements. The bottom plate typically is constructed of silicon, glass, ceramic, plastic or metal. Sputter-coated "passivation" layers may be employed to protect circuits mounted on the bottom plate from ink attack. For example, passivation layers of $Si_3N_4$ and SiC are shown in U.S. Pat. No. 4,809,428. Other inorganic oxide or inorganic nitride materials useful for this purpose are $SiO_2$, $Ta_2O_5$, $Al_2O_3$, glass, BN, etc.

The bottom plate also may be coated with a metal protective layer to impart ink resistance, either with or without a passivation layer. Anti-corrosive metals such as Ti, Cr, Ni, Ta, Mo, W, Nb and the like may be selected for this purpose, or alloys such as stainless steel or noble metals. Noble metals such as gold, palladium or platinum also may be selected, but are more difficult to bond to the photoresist layer.

PHOTORESIST LAYER

The photoresist layer may be applied to the bottom plate either in liquid form, then dried, or preferably as a dry film. The photoresist layer contains an ethylenically unsaturated compound or monomer, a photoinitiator, and a poly(amic acid) prepared from at least one dianhydride and at least one aliphatic diamine in accordance with this invention. Other additives may be present to modify the properties of photopolymer materials. Particularly preferred composites are disclosed in U.S. Pat. No. 4,937,172, and are composed of a monomer that is a half acryloyl ester of bisphenol A epoxy; a photoinitiator system; and a macromolecular elastomeric water-insoluble binder.

Poly(amic acid):

Poly(amic acid) can be easily prepared by reacting a tetracarboxylic dianhydride to at least one aliphatic diamine in an organic solvent.

The tetracarboxylic dianhydride may be represented by the formula:

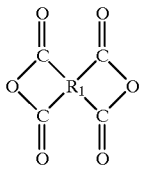

wherein $R_1$ is a tetravalent organic group having 2 to 30 carbon atoms, preferably 6–21 carbon atoms. For example, aliphatic or alicyclic tetracarboxylic dianhydrides can be used to practice the invention. Useful examples include but are not limited to butanetetracarboxylic dianhydride, pentane-tetracarboxylic dianhydride, hexanetetracarboxylic dianhydride, cyclobutanetetracarboxylic dianhydride, cyclopentanetetracarboxylic dianhydride, bicyclohexanetetracarboxylic dianhydride, cyclopropanetetracarboxylic dianhydride, and methylcyclohexanetetracarboxylic dianhydride, ethylene diamine tetraacetic dianhydride, propylene diamine tetraacetic dianhydride and bicyclo octene tetracarboxylic anhydride. The use of an aromatic tetracarboxylic dianhydride can afford a poly(amic acid) which can be converted to a polyimide with superior physical properties. Examples of useful aromatic tetracarboxylic dianhydrides include but are not limited to 2,2'-bis(3,3',4,4'-biphenyl)-hexaflurorpropane dianhydride (6-FDA), 3,3',4,4'-benzophenonetetracarboxylic dianhydride (BTDA), pyromellitic dianhydride (PMDA), oxydiphthalic anhydride (ODPA), 3,3',4,4'-biphenyltetracarboxlic dianhydride, 2,2',3,3'-biphenyltetracarboxlic dianhydride, 2,3,3',-4'-biphenyltetracarboxylic dianhydride, 2,2-bis[5-(3,3-dicarboxyphenoxy)phenyl]propane dianhydride, 2,2-bis(3,-4-dicarboxy-phenyl)propane dianhydride, 2,2'-bis(3,3',4,-4'-biphenylpropane dianhydride, bis(3,4'-dicarboxyphenyl) dimethylsilane dianhydride, bis(3,4-dicarboxyphenyl) dimethylsiloxane dianhydride, 4,4'-isophthaloyl diphthalic anhydride, hydroquinone diether anhydride, sulfonyl bis (phthalic anhydride), and ethyleneglycol bis(trimellitic anhydride), 3,4,9,10-perylenetetracarboxylic dianhydride, 4,4'-sulfonyldiphthalic dianhydride, 3,3'4,4'biphenyltetracarboxylic dianhydride (BPDA), 1,2,5,6-naphthalenetetracarboxylic dianhydride, 2,3,6,7-naphthalenetetracarboxylic dianhydride, 1,4,5,8-naphthalenetetracarboxylic dianhydride, and 2,3,5,6-pyridinetetracarboxylic dianhydride, and mixtures thereof. Many of the dianhydrides are commercially available. The diamine used in the present invention may be represented by the formula:

$$H_2N—R_2—NH_2$$

wherein $R_2$ is a divalent organic group having 1 to 30 carbon atoms, preferably 4 to 18 carbon atoms and more preferably 6 to 12 carbon atoms. Useful examples include but are not limited to 4,4'-oxydianiline (ODA), 4,4'-diaminodiphenylmethane, 4,4'-diaminodiphenylsulfone, 4,41-diaminodiphenyl sulfide, m-phenylenediamine (MPD), p-phenylenediamine, 2,4-diaminotoluene, 2,5-diaminotoluene, 2,6-diaminotoluene, benzidine, 3,3'-dimethylbenzidine, 3,3'-dimethylbenzidine, 3,3'-dimethoxybenzidine, o-tolidine, 4,4"-diaminoterphenyl, 1,5-diaminonaphthalene, 2,5-diaminopyridine, 3,3'-dimethyl-4,4'-diaminodiphenylmethane, 4,4'-bis(p-aminophenoxy)biphenyl, 2,2-bis[4-(p-aminophenoxy) phenyl]propane, and hexahydro-4,7-methanoindanylene dimethylenediamine, 4,4'-diaminodiphenylhexafluoropropane, bisaniline p, bisaniline m, 1,5-naphthalene diamine, 1,4-bis(aminophenoxy) benzene, 2,2-bis[4-(4-aminophenoxyphenyl]propane, 4,4'-(bisaminophenoxy) biphenyl,ethylene dianiline, ethylene diamine, 1,3-diaminopropane, 1,3-diamino-2-hydroxypropane, 1,4-diaminobutane, hexamethylene diamine, 2-methyl-1,5-pentane diamine, 1,7-diaminoheptane, 1,9-diaminononane, 1,10-diaminodecane, 1,12,-dodecane diamine, dodecafluoro dodecane diamine, Jeffamine® D-230, Jeffamine® D-400, Jeffamine® D-2000, Jeffamine® EDR-148, Jeffamine® ED-600, and mixtures thereof. The Jeffamines® are commercially available from The Texaco Chemical Company, Athens, N.Y.

Some suitable aliphatic diamines and dianhydrides are disclosed in U.S. Pat. No. 5,348,835.

The use of a siloxanediamine represented by the following formula can improve the adhesion to an organic substrate:

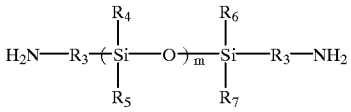

wherein $R_3$ is a divalent organic group having 1 to 10 carbon atoms, $R_4$, $R_5$, $R_6$ and $R_7$ which may be the same or different, are each a monovalent organic group having 1 to 10 carbon atoms, and m is an integer of 1 to 10. The siloxane diamine is used usually in an amount of 1 to 20 mole percent of the total amount of diamine. If the concentration of siloxanediamine is too low, it may not produce the desired improvement on adhesion. If the concentration is too high, the heat resistance will degrade. The proper amount depends on the system and the substrate used, and it can be experimentally obtained. An example of a useful siloxanediamine is bis-3-(aminopropyl)tetramethylsiloxane.

The organic solvent used for the synthesis is preferably also a good solvent for the resulting poly(amic acid). Commonly used are the polar solvents such as, for example, N-methylpyrrolidone, N,N-dimethylacetamide, N,N-dimethylforamide, dimethyl sulfoxide, tetramethylurea, N-methylcaprolactam, Gama-caprolactone, sulfolane, toluene, xylene, 2-pyrrolidone or hexamethylphosphoric triamide.

The poly(amic acid) may be isolated for later use or preferably used as is prepared in solution form. Some poly(amic acids) described above are commercially available from E. I. Du Pont (Wilmington, D.E.) under the trade name of Pyralin®.

The number of acid groups on the poly(amic acid) may be reduced to improve physical properties for handleability and moisture sensitivity during storage, or to obtain better development latitude. This can be accomplished by partial imidization, partial esterification, or use of blends of poly (amic acid) with its ester derivatives. The poly(amic acid) polymer may be present in the amount of 30 to 90%, preferably 40 to 70%, based on the total weight of the photosensitive or photoresist layer. Photoresist layers containing the poly(amic acids) exhibit durable bonds to the top and bottom plates of the print head, improved shelf life, and excellent ink resistance Monomers:

Conventional monomers used in photosensitive resist compositions may be selected in practicing the invention. The selected monomer will preferably contain at least one ethylenically unsaturated groups capable of undergoing polymerization upon exposure to actinic radiation. Excessive amounts of trifunctional acrylate monomers should be avoided as it may cause undue reduction in flexibility.

Some suitable monomers which can be used as the sole monomer, or used in combination with others, include acrylate and methacrylate derivatives of alcohols, isocyanates, esters, epoxides and the like. Examples are diethylene glycol diacrylate, trimethylolpropane triacrylate, pentaerythritol triacrylate, polyoxyethylated and polyoxypropylated trimethylolpropane triacrylate and trimethacrylate and similar compounds as disclosed in U.S. Pat. No. 3,380,831,2-hydroxyethyl acrylate, hydroxypropyl acrylate, hydroxyethyl methacrylate, hydroxypropyl methacrylate, N-methyl diethanolamine dimethacrylate, hexamethylene glycol diacrylate, triethylene glycol diacrylate, tripropylene glycol diacrylate, trimethylolpropane triacrylate, polyoxyethylated trimethylolpropane triacrylate, polyoxypropylated trimetholol propane triacrylate, pentaerythritol tri-and tetracrylate, aromatic urethane diacrylates available from Sartomer, West Chester, Pa., bisphenol-A diacrylate, di-(3-acryloxy-2-hydroxypropyl) ether of bisphenol-A, di-(3-acryloxy-2-hydroxypropyl) ether of tetrabromo-bisphenol-A, or methacrylate analogues thereof as well as aliphatic urethane diacrylates such as those sold by Sartomer, di-(3-methacryloxy-2-hydroxypropyl) ether of tetrachlorobisphenol-A, di-(2-methacryl-oxyethyl) ether of tetrachlorobisphenol-A, di-(3-methacryloxy-2-hydroxypropyl) ether of tetrabromo-bisphenol-A, di-(2-methacryloxyethyl) ether of tetrabromo-bisphenol-A, triethylene glycol dimethacrylate, trimethylol propane triacrylate, polycaprolactone diacrylate, and aromatic urethane oligomeric di(meth)acrylates such as those sold by Sartomer, West Chester, Pa.

A particularly preferred class of monomers is aminoacrylates such as dimethylamino ethylmethacrylate, 3-(N,N-dimethylamino)propyl methacrylate, dimethylaminoethyl acrylate, dimethylamino)propyl methacrylamide and 2-tert. butylaminoethyl methacrylate.

The monomer(s) typically will constitute 5 to 50%, preferably 20 to 40%, by weight of the total weight of the photoresist layer.

Photoinitiator:

Conventional photoinitiators, or photoinitiator systems, may be selected in practicing the invention. The initiator directly furnishes free radicals when activated by actinic radiation. A sensitizer also may be present, typically to extend spectral response into the near ultraviolet, visible, and near infrared spectral regions.

Sensitizers which improve photospeed when used in combination with the phosphorous containing compound include the bis(p-dialkylaminobenzylidene) ketones disclosed in Baum et al., U.S. Pat. No. 3,652,275, and the arylidene aryl ketones disclosed in Dueber, U.S. Pat. No. 4,162,162. Some other initiators which improve photospeed when used in combination with the phosphorous containing compound include hydrogen donor compounds that function as chain transfer agents in the photopolymer compositions include: 2-mercapto-benzoxazole, 2-mercaptobenzothiazole, 4-methyl-4H-1,2,4-triazole-3-thiol, etc.; as well as various compounds disclosed in column 12, lines 18 to 58 of MacLachlan, U.S. Pat. No. 3,390,996. Suitable hydrogen donor compounds for use in systems containing both biimidazole type initiator and N-vinyl carbazole are 5-chloro-2-mercaptobenzo-thiazole; 2-mercaptobenzo-thiazole; 1H-1,2,4-triazole-3-thiol; 6-ethoxy-2-mercaptobenzothiazole; 4-methyl-4H-1,2,4-triazole-3-thiol; 1-dodecane-thiol; and mixtures thereof.

Preferred photoinitiator systems, which improve photospeed alone or in combination with the phosphorous containing compound, include 2,4,5-triphenylimidazolyl dimers in combination with chain transfer agents, or hydrogen donors, such as those disclosed in U.S. Pat. Nos. 3,479,185; 3,784,557; 4,311,783; and 4,622,286. Preferred hexaarylbiimidazoles (HABI) are 2-ortho-chlorosubstituted hexaphenylbiimidazoles in which the other positions on the phenyl radicals are unsubstituted or substituted with chloro, methyl or methoxy. The most preferred initiator is ortho-Cl-HABI, i.e., 1,1'-biimidazole, 2,2'-bis(ortho-chlorophenyl)-4,4',5,5'-tetraphenyl-imidazole dimer.

A large number of free-radical generating compounds, including redox systems such as Rose Bengal/2-dibutylaminothanol, may be selected to advantage. Sensitizers useful with photoinitiators include methylene blue and those disclosed in U.S. Pats. Nos. 3,554,753; 3,563,750; 3,563,751; 3,647,467; 3,652,275; 4,162,162; 4,268,667; 4,351,893; 4,454,218; 4,535,052; and 4,565,769.

A particularly preferred class of photoinitiators and photosensitizers, which improve photospeed when used in combination with the phosphorous containing compound, are benzophenone, Michler's ketone, ethyl Michler's ketone, p-dialkylaminobenzaldehydes, p-dialkylaminobenzoate alkyl esters, polynuclear quinones, thioxanthones, hexaarylbiimidazoles, cyclohexadienones, benzoin, benzoin dialkyl ethers, or combinations thereof where alkyl contains 1 to 4 carbon atoms.

The photoinitiator, or photoinitiator system, typically will constitute 0.5 to 10%, preferably 2 to 5%, by weight of the total weight of the photoresist layer.

Additives:

Conventional additives incorporated in photosensitive compositions may be included. For example, the photoresist may contain binders, thermal polymerization inhibitors such as p-methoxy phenol, hydroquinone and alkyl and aryl-substituted hydroquinones and quinones, tertiary butyul catechol, pyrogallol, copper resinate, naphthylamines, betanaphthol, cuprous chloride, 2,6-di-ter-butyl-p-cresol, phenothiazine, pyridine, nitrobenzene, dinitrobenzene, p-toluquinone and chloranil. Also useful as thermal polymerization inhibitors are the nitroso compositions disclosed in U.S. Pat. No. 4,168,982. Various dyes and pigments may be added to increase the visibility of the resist image, provided the dye or colorant is transparent to the actinic radiation used to create the ink channels in the photoresist layer.

Suitable binders which can be used as the sole binder, or in combination with others, include the following: polyacrylate and alpha-alkyl polyacrylate esters (e.g., polymethyl methacrylate, polyethyl methacrylate, polybutyl methacrylate and polyhexyl methacrylate); copolymers and terpolymers of isobornyl acrylate, hydroxyethyl methacrylate, and butane diacrylate; copolymers of glycidyl ethers with the above mentioned monomers; polyvinyl esters (e.g., polyvinyl acetate, polyvinyl acetate/acrylate, polyvinyl acetate/methacrylate and hydrolyzed polyvinyl acetate); ethylene/vinyl acetate copolymers; polystyrene polymers and copolymers; saturated and unsaturated polyurethanes; synthetic rubbers (e.g., butadiene/acrylonitrile, acrylonitrile/butadiene/styrene and/or bromostyrene, methyl methacrylate/acrylonitrile/-butadiene styrene copolymers, 2-chlorobutadiene/1,3-polymers, and styrene/-butadiene/styrene, styrene/isoprene/styrene block copolymers); polybromostyrene; polyethylene oxides of polyglycols having average molecular weights from about 4,000 to 1,000,000; epoxides (e.g., epoxides containing acrylate or methacrylate groups); copolyesters, e.g., those prepared from the reaction product of a polymethylene glycol of the formula HO(CH2)nOH, where n is a whole number 2 to 10 inclusive, and (1)

hexahydroterephthalic, sebacic and terephthalic acids, (2) terephthalic, isophthalic and sebacic acids, (3) terephthalic and sebacic acids, (4) terephthalic and isophthalic acids, and (5) mixtures of copolyesters prepared from said glycols and (i) terephthalic, isophthalic and sebacic acids and (ii) terephthalic, isophthalic, sebacic and adipic acids; nylons or polyamides, e.g., N-methoxymethyl polyhexamethylene adipamide; cellulose esters, e.g., cellulose acetate, cellulose acetate succinate and cellulose acetate butyrate; cellulose ethers, e.g., methyl cellulose, ethyl cellulose and benzyl cellulose; polycarbonates; polyvinyl acetal, e.g., polyvinyl butyral, polyvinyl formal; polyformaldehyde. The composition may also contain a preformed macromolecular elastomeric polymer binder similar to that disclosed in U.S. Pat. No. 4,937,172.

The binder(s) typically will constitute 0 to 50%, preferably 0 to 30%, by weight of the total weight of the photoresist layer.

Inorganic as well as organic fillers may also be added to the photoresist layer components to improve the mechanical properties of the cured film. Preferably, during preparation, the filler is the last component added just prior to thorough mixing, e.g. with a roll mill, to disperse the filler forming a homogeneous composition. Typical fillers used are surface treated oxides of silicon, aluminum and magnesium.

Thickness:

Thickness of the resin layer can range widely, in accordance with design requirements. U.S. Pat. No. 4,970,532, for example, discloses a thickness range of 20 to 200 microns. Variation from the desired thickness, however, must be minimized to maintain consistent ink drop volumes from each nozzle. U.S. Pat. No. 4,994,826 discloses a maximum tolerance of +/−5% of resin layer thickness. Dry film photoresist materials offer consistent thickness in high volume over liquid resists and eliminate the costs of constant wafer-to-wafer quality assurance programs associated with spin-cast liquid resists.

The negative resin layers or resist materials are capable of aspect ratios of about 1.5 to 5 (i.e., 10 micron channels can be produced from films as thick as about 50 microns). Narrower channels can be produced with proportionately thinner films. Such resolution is dependent on several factors, such as the selected light source, photochemistry of the photoresist material, adhesion of the cured photopolymer to the first substrate, and selection of the development process, which includes the proper choice of developing liquid.

The resist layer is normally imaged with actinic radiation through a target which is registered with the underlying microresistors. Collimated light generally is used to obtain channel walls perpendicular to the bottom plate. Channel walls can be made either thinner or thicker at the top than at bottom, depending on the choice and balance of active ingredients.

The development process makes use of a difference in solubility of exposed and unexposed material. This difference in solubility can be maximized by the choice of developing liquid. The unexposed resist should show only moderate solubility in the developer. Solvents used for coating or stripping are generally too aggressive when used as developing solvents. When developing liquids are too aggressive, the photocured resist or resin layer tends to swell and peel from the substrate and development latitude is diminished.

Excessive stresses imposed during the development process can remove finer features of imaged resist or resin layer from the substrate and cause an apparent loss of resolution.

Photoimageable polyamic acid films can also be developed in an aqueous medium such as an aqueous solution of tetramethyl ammonium hydroxide, or aqueous solutions of triethanolamine or triethylamine.

TOP PLATE

The top plate is then bonded, preferably laminated, to the developed and thermally cured photoresist layer. The top plate may have a support plate and a surface layer of a noble metal. Some examples of support plates include glass, ceramics, metal, plastics, thermoplastic resins such as acrylic resins, ABS resins, polyethylene and the like. Some examples of noble metals include gold, platinum, palladium and iridium.

PROCESS

The various print head manufacturing processes differ in how each of these general steps is done. The photopolymerizable poly(amic acid) is spin coated on a bottom plate such as a silicon wafer. The wafer is soft baked at 80 to 105° C. until the surface is tack dry. The dried wafer is exposed to actinic radiation through a positive or negative transparency and then developed and thermally cured at 150 to 400° C., preferably 180 to 250° C. In one embodiment, a noble metal-surfaced top plate may be aligned appropriately with features on the face of a bottom plate that bears printed microcircuits and an imaged and developed resin layer, and then bonded with the resin layer or resist surface using heat and pressure. After cooling, and cutting one or more ink jet print heads, with improved adhesion of the resist to the top and bottom plates, are produced.

EXAMPLES

The following examples, wherein parts and percentages are by weight, illustrate but do not limit the invention.

Poly(amic acid) Synthesis 1:

The synthesis of polyamic acid was carried out in a dry box at room temperature. 11.6 grams of hexamethylene diamine(HMD) were added to 509 mL of anhydrous dimethylacetamide in a beaker and the solution was stirred until all the solids dissolved. 30.03 grams of oxydianiline(ODA) were then added and dissolved in this solution. The solution was slightly brownish in color. 79.6 grams of oxydiphthalic anhydride (ODPA) were slowly added, with constant stirring, over a period of 4–6 hours. A white precipitate was first formed. The precipitate started to dissolve after about ⅔ of ODPA had been added. Also the solution temperature rose to 40–60° C. Addition of ODPA was continued after all the precipitate was dissolved. The solution viscosity increased during this addition. The last 2 grams of ODPA were added in 100 mg quantities. The solution was stirred for one more hour after the addition was complete. Viscosity of the solution was determined to be 118 P.

Poly(amic acid) Synthesis 2:

The procedure outlined in Synthesis 1 was repeated with the following exceptions: 18.85 grams of 2-methylpentamethylene diamine and 605 mL of anhydrous dimethylacetamide were used instead of 11.6 grams of hexamethylene diamine(HMD) and 509 mL of anhydrous dimethylacetamide, respectively. 32.5 grams of oxydianiline (ODA) and 100.44 grams of BPDA, respectively, were used. Viscosity of the solution was determined to be 79 P.

Poly(amic acid) Synthesis 3:

The synthesis of polyamic acid was carried out in a dry box at room temperature. 73 grams of 1,3-bis(3-aminophenoxy) benzene (APB-133) were added to 450 mL of anhydrous dimethylacetamide in a beaker and the solution was stirred until all the solids dissolved. The solution was slightly brownish in color. 78.4 grams of oxydiphthalic anhydride (ODPA) were slowly added, with constant stirring, over a period of 4–6 hours. A white precipitate was first formed. The precipitate started to dissolve after about ⅔ of ODPA had been added. Also the solution temperature rose to 40–60° C. Addition of ODPA was continued after all the precipitate was dissolved. The solution viscosity increased during this addition. The last 2 grams of ODPA were added in 100 mg quantities. The solution was stirred for one more hour after the addition was complete. Viscosity of the solution was determined to be 72 P.

Poly(amic acid) Synthesis 4:

The procedure outlined in Synthesis 1 was repeated with the following exceptions: 500 mL of anhydrous dimethylacetamide were used. 77.25 grams of BPDA were used instead of 79.6 grams of ODPA. Viscosity of the solution was determined to be 422 P.

Poly(amic acid) Synthesis 5:

The synthesis of polyamic acid was carried out in a dry box at room temperature. 8.6 grams of hexamethylene diamine(HMD) were added to 580 mL of anhydrous dimethylacetamide and the solution was stirred until all the solids dissolved. 71.75 grams of 2,2-bis(aminophenyl phenoxy) propane (BAPP) were then added and dissolved in this solution. The solution was slightly brownish in color. 62.04 grams of the anhydride and 10.9 grams of PMDA were mixed and then slowly added, with constant stirring, over a period of 4–6 hours. A white precipitate was first formed. The precipitate started to dissolve after about ⅔ of ODPA had been added. Also the solution temperature rose to 40–60° C. Addition of the anhydride was continued after all the precipitate was dissolved. The solution viscosity increased during this addition. The last 2 grams of the anhydride were added in 100 mg quantities. The solution was stirred for one more hour after the addition was complete. Viscosity of the solution was determined to be 289 P.

Poly(amic acid) Synthesis 6:

The synthesis of polyamic acid was carried out in a dry box at room temperature. 58.5 grams of 1,4-bis (aminophenoxy) benzene(RODA) were added to 508 mL of anhydrous dimethylacetamide and the solution was stirred until all the solids dissolved. The solution was slightly brownish in color. 29.4 grams of BPDA and 31.0 grams of ODPA were mixed in a beaker. The mixture was then slowly added, with constant stirring, over a period of 4–6 hours. A white precipitate was first formed. The precipitate started to dissolve after about ⅔ of the anhydride had been added. Also the solution temperature rose to 40–60° C. Addition of the anhydride was continued after all the precipitate was dissolved. The solution viscosity increased during this addition. The last 2 grams of the anhydride were added in 100 mg quantities. The solution was stirred for one more hour after the addition was complete. Viscosity of the solution was determined to be 458 P.

Poly(amic acid) Synthesis 7:

The polyamic acid synthesis was carried out in a dry box at room temperature. 15.08 grams of hexamethylene diamine(HMD) were added to 562 mL of anhydrous dimethylacetamide and the solution was stirred until all the solids dissolved. 38.0 grams of bis(aminophenoxy) benzene (RODA) were dissolved in this same solution. The solution was slightly brownish in color. 38.25 grams of BPDA and 40.33 grams of ODPA were mixed in a beaker. The mixture was added slowly with constant stirring over a period of 4–6 hours. A white precipitate formed first. The precipitate started to dissolve after about ⅔ of the anhydride had been added with a solution temperature increase to 40–60° C. Addition of the anhydride mixture was continued after all the precipitate was dissolved. The solution viscosity increased during this addition. The last 2 grams of the anhydride mixture were added in 100 mg quantities. The solution was stirred for one more hour after the addition was complete. Viscosity of the solution was determined to be 236 P.

Poly(amic acid) Synthesis 8:

The polyamic acid synthesis was carried out in a dry box at room temperature. 21.84 grams of 2-methylpentamethylene diamine were added to 546 mL of anhydrous dimethylacetamide and the solution was stirred until all the solids dissolved. 56.48 grams of bis (aminophenoxy) benzene (RODA) were dissolved in this same solution. The solution was slightly brownish in color. 44.10 grams of BPDA and 65.72 grams of ODPA were mixed in a beaker. The mixture was added slowly with constant stirring over a period of 4–6 hours. A white precipitate formed first. The precipitate started to dissolve after about ⅔ of the anhydride had been added with a solution temperature increase to 40–60° C. Addition of the anhydride mixture was continued after all the precipitate was dissolved. The solution viscosity increased during this addition. The last 2 grams of the anhydride mixture were added in 100 mg quantities. The solution was stirred for one more hour after the addition was complete. Viscosity of the solution was determined to be 136 P.

Photoimageable Polyamic Acid Solution Preparation:

Amino acrylate monomer was added in small increments to the poly(amic acid), under constant stirring. o-Chlorohexaarylbiimidazole and ethyl Michler's ketone were then added and stirred until the solution was homogeneous and contained no gels.

RESOLUTION

Resolution was determined using the following procedure: Two single crystal silicon wafers covered with a thin layer of chemical vapor deposited (CVD) Tantalum metal were used as the substrates. Each photoimageable thermoplastic polyamic acid solution prepared by the procedures outlined in Polyamic Acid Synthesis 8 and 1, respectively, was spin coated on the silicon wafers. Spread, ramp and spin speed conditions were adjusted so that the thickness of the coated film after soft bake was about 30–40 microns. The wafer was soft baked at 85° C. for approximately 5 min. until the film surface was found to be tack dry. The film was exposed to actinic radiation through a transparency. Immediately after exposure to actinic radiation, the wafer was baked at 85° C. for 1 min. The wafer was developed in a atomized spin spray developer using N-methylpyrrolidone and rinsed with isopropanol. The development time was determined using an unexposed wafer prepared under similar conditions. The developed wafer was examined under microscope and the smallest isolated line and space were recorded.

| INGREDIENTS | SAMPLE 1 | SAMPLE 2 |
|---|---|---|
| Poly (amic acid) from Synthesis 8 | 150.00 | |
| Poly (amic acid) from Synthesis 1 | | 150.00 |
| Dimethylaminoethyl methacrylate | 22.50 | 22.50 |
| o-chlorohexaarylbiimidazole | 1.05 | 1.05 |
| Ethyl Michler's ketone | 0.15 | 0.15 |

-continued

| INGREDIENTS | SAMPLE 1 | SAMPLE 2 |
|---|---|---|
| RESOLUTION: | | |
| Channels | 10 | 20 |
| Lines | 10 | 20 |

An acrylic photopolymer film, Parad® PO300, manufactured by DuPont, Wilmington, Del. resolves 20–30 micron lines and channels when developed in a spin spray developer following the recommended conditions.

ADHESION TO THE SUBSTRATE

Adhesion to the substrate was measured using the following procedure:

Two single crystal silicon wafers covered with a thin layer of chemical vapor deposited (CVD) Tantalum metal were used as the substrates. Each photoimageable thermoplastic polyamic acid solution prepared by the procedures outlined in Polyamic Acid Synthesis 2 and 4, respectively, was spin coated on the silicon wafers. Spread, ramp and spin speed conditions were adjusted so that the thickness of the coated film after soft bake was about 30–40 microns. The wafer was soft baked at 80° C. for approximately 5 min. until the film surface was found to be tack dry. The film was exposed to actinic radiation through a transparency. Immediately after exposure to actinic radiation, the wafer was baked at 105° C. for 1 min. The wafer was developed in a atomized spin spray developer using N-Methylpyrrolidone and rinsed with isopropanol. The development time was determined using an unexposed wafer prepared under similar conditions. The developed wafer was examined under microscope and the smallest isolated squares that adhered to the surface were recorded.

| INGREDIENTS | SAMPLE 1 | SAMPLE 2 |
|---|---|---|
| Poly (amic acid) from Synthesis 2 | 50.00 | |
| Poly (amic acid) from Synthesis 4 | | 50.00 |
| Dimethylaminoethyl methacrylate | 7.50 | 7.50 |
| o-chlorohexaarylbiimidazole | 0.35 | 0.35 |
| Ethyl Michler's ketone | 0.05 | 0.05 |
| ADHESION: | 10 × 10 $\mu$ | 10 × 10 $\mu$ |

The table shows that the thermoplastic photoimageable polyamic acid based films had all the 10×10 micron size squares adhered to the substrate, with 10×10 micron being the smallest feature in the transparency.

Control sample, which was an acrylic photopolymer film, Parad® PO300, manufactured by DuPont, had 25×25$\mu$ squares adhered to the surface after development following the recommended conditions.

INK RESISTANCE

Ink resistance was measured using the following procedure:

Two single crystal silicon wafers covered with a thin layer of chemical vapor deposited (CVD) Tantalum metal were used as the substrates. Each photoimageable thermoplastic polyamic acid solution prepared by the procedures outlined in Polyamic Acid Synthesis 2 and 4, respectively, was spin coated on the silicon wafers. Spread, ramp and spin speed conditions were adjusted so that the thickness of the coated film after soft bake was about 30–40 microns. The wafer was soft baked at 80° C. for approximately 5 min. until the film surface was tack dry. The film was exposed to actinic radiation through an art work. UV exposure that showed the best resolution and adhesion to the substrate was used. Immediately after exposure to actinic radiation, the wafer was baked at 105° C. for 1 min. The wafer was developed in a atomized spin spray developer using N-Methylpyrrolidone and rinsed with isopropanol. The development time was determined using an unexposed wafer prepared under similar conditions. The wafer was baked at 250° C. for 30 min. Small pieces of the wafer containing the cured photopolymer film were immersed in pre-heated N-Methylpyrrolidone at 80° C. and covered. The container was placed in an oven at 80° C. The sample was taken out periodically and the surface of the photopolymer film was rubbed with a nickel spatula. If the film did not delaminate or soften, the sample was placed again in the oven at 80° C. Examination of the sample continued until the film delaminated or the film turned very soft.

| INGREDIENTS | SAMPLE 1 | SAMPLE 2 |
|---|---|---|
| Poly (amic acid) from Synthesis 2 | 100.00 | |
| Poly (amic acid) from Synthesis 4 | | 100.00 |
| Dimethylaminoethyl methacrylate | 15.00 | 19.80 |
| Dytek ® A, Dupont, Wilmington, DE | | 0.20 |
| o-chlorohexaarylbiimidazole | 0.70 | 0.50 |
| Ethyl Michler's ketone | 0.10 | 0.10 |
| INK RESISTANCE: | >8 hours | >8 hours |

Control sample, which was an acrylic photopolymer film, Parad® PO-300, manufactured by DuPont, Wilmington, Del. had an ink resistance of <0.5 hours following the recommended conditions.

ADHESION TO THE TOP PLATE

Adhesion to the top plate was determined using the following procedure:

A Teflon tape was placed on the edges of a microscopic slide. Thickness of the Teflon tape was 0.0254 microns (10 mils). Photoimageable polyamic acid was poured on one side of the microscopic glass slide. The solution was doctored using another glass slide. The microscopic slide was placed in an oven at 80° C. for 30 min. The film was touch dry after this soft bake. Teflon tapes were removed. The slide was placed in an oven at 200° C. for 30 min.

The glass slide was placed on a Pasadena Press pre-heated to 315.6° C. (600° F.). The cured photopolymer side was facing up. A 5.08 cm×1.27 cm (2"×0.5"), 5.08 microns (2 mil) thick polyimide film was placed on the cured photopolymer. A (15.24 cm×15.24 cm (6"×6") size Kapton® film, manufactured by DuPont, Wilmington, Del., was placed on top of the glass slide so that the uncovered photopolymer film did not adhere to the press platen. A pressure of 2000 psi was applied for 10 min. The sample was taken out and cooled to room temperature. The peel force to remove the polyimide film from the cured thermoplastic polyimide film was determined using an Instron Tensile Tester, manufactured by Instron Corporation, Canton, Mass.

| POLY (AMIC ACID) | SAMPLE 1 | SAMPLE 2 | SAMPLE 3 | SAMPLE 4 | SAMPLE 5 |
|---|---|---|---|---|---|
| Synthesis 3 | 100.00 | | | | |
| Synthesis 4 | | 100.00 | | | |
| Synthesis 5 | | | 100.00 | | |
| Synthesis 6 | | | | 100.00 | |
| Synthesis 7 | | | | | 100.00 |
| DMAEMA | 19.80 | 19.80 | 19.80 | 19.80 | 19.80 |
| Dytek ® A | 0.20 | 0.20 | 0.20 | 0.20 | 0.20 |
| o-Cl-HABI | 0.50 | 0.50 | 0.50 | 0.50 | 0.50 |
| EMK | 0.10 | 0.10 | 0.10 | 0.10 | 0.10 |
| Adhesion Force[1]: | | | | | |
| copper | 606 | 101 | 672 | 401 | 888 |
| Aluminum | 305 | 766 | 201 | 448 | 80 |
| polyimide | 1117 | 566 | 1906 | 510 | 697 |

DMAEMA Dimethylaminoethyl methacrylate o-Cl-HABI o-chlorohexaarylbiimidazole

EMK Ethyl Michler's ketone

1 Grams per linear inch of the orifice plate

The adhesion forces for the control samples made from Parad® 300, a permanent additive photoresist manufactured by Dupont, Wilmington, Del., were 105, 136 and 32 for copper, aluminum and polyimide, respectively. Parad® 300 was hot roll laminated on the glass slide and processed using the recommended conditions. Photoimageable thermoplastic polyamic acid based films showed improved adhesion to metal as well as plastic orifice plates.

What is claimed is:

1. An ink jet print head comprising a top plate, a bottom plate and intermediate photoresist layer having a thickness of at least 20 microns, said intermediate photoresist layer being in intimate contact with and fixedly adhered to the top plate and the bottom plate, the photoresist layer having ink passageways therein formed by photoimaging the photoresist, and wherein the photoresist layer, prior to imaging to form said ink passageways, comprises an ethylinically unsaturated compound, a photoinitiator, and a poly(amic acid) prepared from at least one dianhydride and at least one aliphatic diamine.

2. The print head of claim 1 wherein the dianhydride is a tetracarboxylic dianhydride represented by the formula:

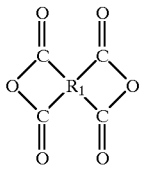

wherein $R_1$ is a tetravalent organic group having 2 to 30 carbon atoms.

3. The print head of claim 2 wherein the diamine is represented by the formula:

$$H_2N—R_2—NH_2$$

wherein $R_2$ is a divalent organic group having 1 to 30 carbon atoms.

4. The print head of claim 3 wherein $R_2$ has 4 to 12 carbon atoms.

5. The print head of claim 1 wherein the poly(amic acid) is present in the amount of approximately 30 to 90% by weight, based on total weight of the photoresist layer.

6. The print head of claim 1 wherein the poly(amic acid) is present in the amount of approximately 40 to 70% by weight, based on total weight of the photoresist layer.

7. The print head of claim 1 wherein the photoresist layer further contains a siloxanediamine.

8. The print head of claim 1 wherein the ethylenically unsaturated compound is an aminoacrylate.

9. The print head of claim 8 wherein the aminoacrylate is present in the amount of approximately 5 to 50% by weight, based on total weight of the photoresist layer.

10. The print head of claim 1 wherein the photoinitiator is present in the amount of approximately 0.5 to 10% by weight, based on total weight of the photoresist layer.

11. The print head of claim 1 wherein the photoresist layer further contains a binder.

12. The print head of claim 1 wherein the photoresist layer further contains an organic or inorganic filler.

13. The print head of claim 12 wherein the inorganic filler is selected from the group consisting of surface treated oxides of silicon, aluminum and magnesium.

* * * * *